United States Patent [19]

Moomaw

[11] Patent Number: 4,713,036

[45] Date of Patent: Dec. 15, 1987

[54] TOY SIMULATOR POWER DRIVEN RECIPROCATING SAW WORKSHOP

[75] Inventor: David E. Moomaw, East Aurora, N.Y.

[73] Assignee: The Quaker Oats Company, Chicago, Ill.

[21] Appl. No.: 923,631

[22] Filed: Oct. 27, 1986

[51] Int. Cl.[4] ..... A63H 33/30

[52] U.S. Cl. ..... 446/145; 446/489; 434/260

[58] Field of Search ..... 446/145, 144, 424, 479, 446/491, 314, 489, 1; 434/260

[56] References Cited

U.S. PATENT DOCUMENTS

| | | | |
|---|---|---|---|
| 1,647,537 | 11/1927 | Morgan | 446/145 |
| 2,313,158 | 3/1943 | Long | 446/314 |
| 3,390,483 | 7/1968 | Doe | 446/145 |

FOREIGN PATENT DOCUMENTS

| | | | |
|---|---|---|---|
| 468002 | 11/1928 | Fed. Rep. of Germany | 446/314 |

*Primary Examiner*—Mickey Yu

*Attorney, Agent, or Firm*—Cumpston & Shaw

[57] ABSTRACT

A toy power driven reciprocating saw workshop is disclosed for simulating the sawing action of a real power driven reciprocating saw cutting a groove through a board. The power driven reciprocating saw workshop having an elongated board having an elongated slot extending therethrough within which an elongated bar is supported adjacent a row of saw teeth on a side of the slot. The saw teeth and one end of the bar form an escapement adapted when one end of the bar is reciprocated and pressed forwardly along the slot by a reciprocating member to intermittently move the bar along the slot one tooth at a time, simulating the sawing action of a real reciprocating saw cutting a groove through a board.

9 Claims, 4 Drawing Figures

TOY SIMULATOR POWER DRIVEN RECIPROCATING SAW WORKSHOP

FIELD OF THE INVENTION

The present invention relates to toys, and more particularly to a toy simulated power driven reciprocating saw workshop.

DESCRIPTION OF THE PRIOR ART

One of the greatest problems facing toy manufacturers today is to produce toys that realistically emulate the corresponding adult counterpart. Children love to mimic their parents, and when a parent is in the family workshop using a power saw to saw wood, or a power drill to drill holes, the child desires to follow suit. The problem facing toy producers is to design and produce toys that closely resemble the real power saw or power drill in looks and particularly in action, and yet are completely safe in operation. This problem is solved in this invention by providing a toy power driven reciprocating saw workshop that realistically simulates the sawing action and motion of a real power driven reciprocating saw cutting through a board.

SUMMARY OF THE INVENTION

An object of the present invention is to provide a toy simulated power driven reciprocating saw workshop for simulating the sawing action of a real power driven reciprocating saw as it cuts a groove through a board comprising:

means defining an elongated slot extending therethrough;

bar means;

means for supporting the bar means within the slot; and escapement means between the bar and the board adpated when the bar means is reciprocated and pressed fowardly along the slot to intermittently move the bar means in steps along the slot simulating the movement of a real power driven reciprocating saw cutting a groove through the board.

In a more specific object of the invention, the escapement means comprises a pair of spaced-apart rows of right-angled saw teeth along one side of the slot in which the rows of saw teeth are arranged in facing, offset or staggered relation. The bar has at least one lug facing one row of saw teeth, and at least one opposite lug facing the other row of saw teeth. The bar further has a rip on an end surface adjacent the lugs. A reciprocating means is provided for engaging the rib and reciprocating the bar as it is pressed forwardly causing the bar to move forwardly intermittently one tooth at a time.

BRIEF DESCRIPTION OF THE DRAWINGS

In the detailed description of the invention presented below, reference is made to the accompanying drawings, in which.

DETAILED DESCRIPTION OF THE INVENTION

Figure 1:
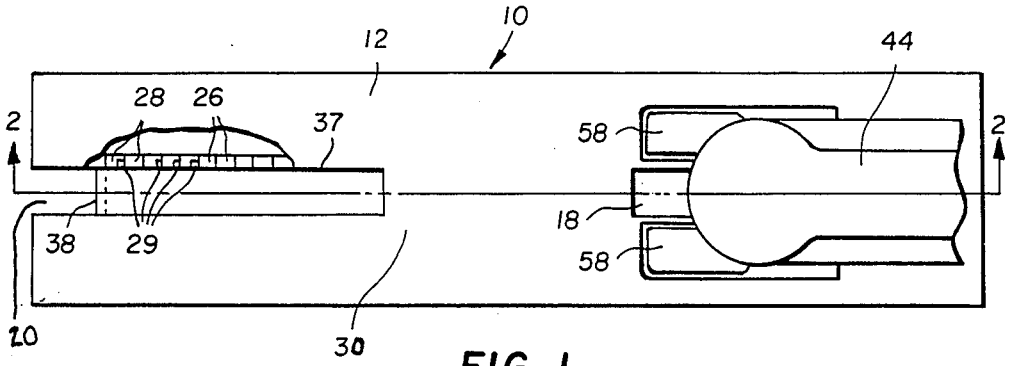
FIG. 1 is a top plan view of a preferred embodiment of the toy simulated power driven reciprocating saw workshop of this invention.
Figure 2:
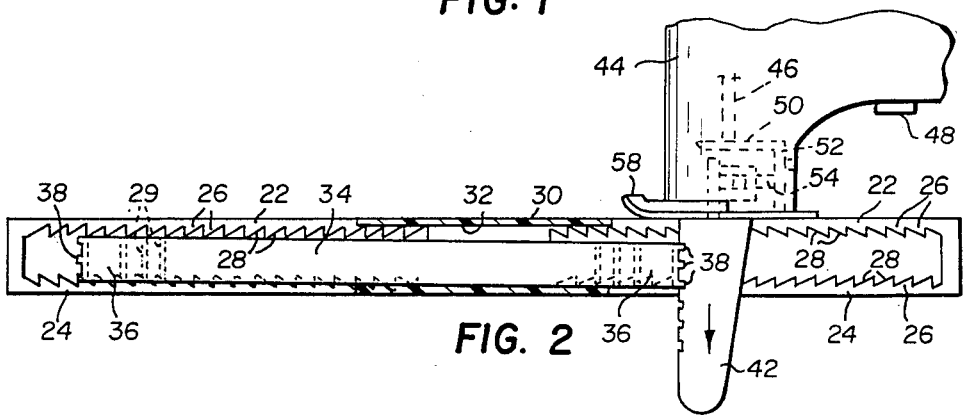
FIG. 2 is a section view taken substantially along line 2—2 of FIG. 1.
Figure 3:
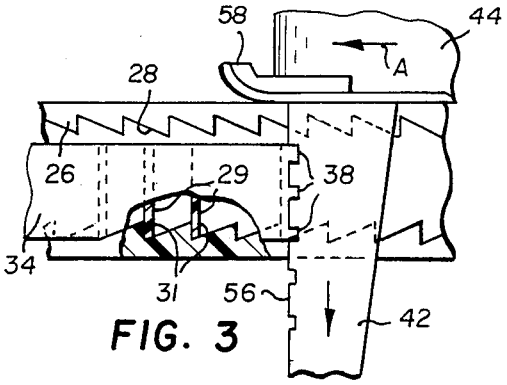
FIG. 3 is an enlarged fragmentary view, partially in sections, of a portion of the toy simulated power driven reciprocating saw workshop.

Referring now to FIGS. 1 and 2 of the drawings, a preferred embodiment of the toy simulated power driven reciprocating saw workshop 10 of this invention is disclosed. The workshop 10 comprises a plastic board 12 formed from upper and lower halves secured together by any suitable means. Opposite ends of the board are provided with slots 18, 20 extending therethrough, each having upper and lower rows 22, 24 respectively of right-angled saw teeth 26 along one side thereof arranged in facing, offset or staggered relation. On right end slot 18, as best seen in FIG. 3, slanted portions 28 of saw teeth 26 are arranged so as to direct or guide a follower lug 29 riding on that portion to the left in the direction of arrow A until the lug bottoms in the saw tooth. On left hand slot, 20, as best seen in FIG. 2, the slanted portions 28 of saw teeth 26 are arranged so as to direct or guide a follower lug on that portion to the right.

The mid-section 30 of board 12 defines a tunnel 32 through which an elongated bar 34 extends with the lower surface of the bar resting on the lower surface of the tunnel. Each end portion 36 of bar 34 is provided with one or more laterally extending ribs 38, and the side surfaces 37 of the end portions are provided with one or more of the aforementioned laterally extending lugs 29 facing a complementary row of saw teeth 26, as best seen in FIGS. 1 and 3.

Figure 4:
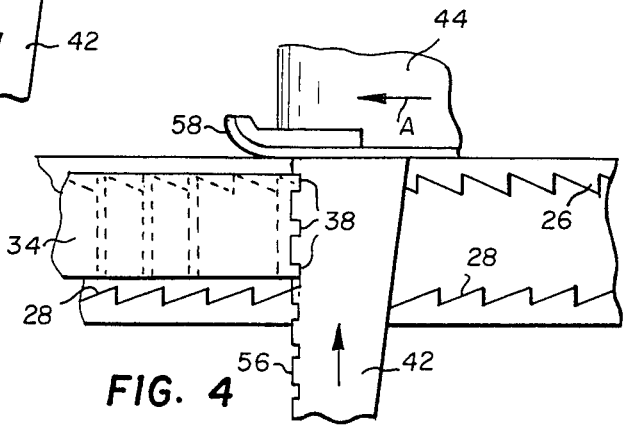
FIG. 4 is a view similar to FIG. 3 showing the drive rack and escapement in the up position.

With reference to FIGS. 3 and 4 the bar lugs 29 and rows of saw teeth 26 form an escapement means which is adapted when a bar end portion 36 is simultaneously reciprocated and pressed toward mid-section 30 of board 12 to advance bar 34 one tooth at a time. For example, as bar end portion 36 is moved from the FIG. 3 position to the FIG. 4 position, lug ends 31 engage substantially the centers of the upper slanted portions 28 and are then pressed along with bar 34 in the direction of arrow A until lug ends 31 bottom in the upper saw teeth, as seen dotted in FIG. 4. Movement of bar and portion 36 from the FIG. 4 position to the FIG. 3 position again causes lug ends 31 to engage the centers of the lower slanted portions 28 which are pressed along with bar 34 in the direction of arrow A until lug ends 31 bottom n the lower saw teeth, as shown. As one bar end portion 36 is reciprocated, the opposite bar end portion merely slides along the slanted portions 28 of the row of saw teeth 26 with which it is in engagement.

The means for reciprocating bar end portions 36 comprises a power driven reciprocating toothed rack means 42 that simulates a power driven reciprocating saw. The power driven reciprocating toothed rack means comprises a hollow plastic hand gun 44 containing an electrical motor, not shown, having an output shaft 46, batteries, not shown, and a switch 48 on the hand grip for electrically connecting the batteries to the motor for rotatably driving the shaft to which a pinion gear 50 is secured. The pinion gear rotates a circular gear 52 at right angles thereto, having a laterally extending eccentric pin 54 for reciprocally driving a toothed rack 56 slidably mounted on the spindle end of the hand gun upon rotation of gear 50. The child places hand gun 44 and toothed rack 56 within one of the slots 18, 20 until a stop plate 58 bottoms on the upper surface of board 12. The toothed rack is moved into engagement with ribs 38, and to reciprocate bar 34 as the rack is pressed toward mid-section 30 of board 12. This action causes hand gun 44, toothed rack 56 and bar 34 to move, one tooth 26 at a time, toward the mid-section of the board simulating the movement of a real power driven reciprocating saw as it cuts a groove through a board.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A toy simulated power driven reciprocating saw workshop for simulating the sawing action of a real power driven reciprocating saw cutting a groove through a board, comprising:

saw means;

means defining an elongated slot extending therethrough;

bar means;

means for supporting the bar means within the slot substantially parallel thereto; and escapement means between the bar means and the slot defining means adapted when the bar means is reciprocated and pressed forwardly along the slot to intermittently move the bar means in steps along the slot by said saw means simulating the movement of a real power driven reciprocating saw cutting a groove through a board.

2. A toy simulated power driven reciprocating saw workshop according to claim 1 wherein the escapement means comprises a pair of spaced-apart rows of substantially right-angled saw teeth along one side of the slot, and the bar means comprises an elongated bar having end sections and corners, and upper and lower lugs on the corners of the end sections of the bar adapted when simultaneously reciprocated into engagement with the rows of saw teeth and pressed forwardly along the slot to cause the bar to intermittently advance one step at a time.

3. A toy simulated power driven reciprocating saw workshop according to claim 2 wherein the means defining an elongated slot comprises a board and the supporting means is defined by a tunnel formed in said board.

4. A toy simulated power driven reciprocating saw workshop according to claim 3, and further comprising a laterally extending rib on an end surface of the bar and a power driven reciprocating toothed rack means mountable within the slot and adapted when reciprocated and pressed into engagement with the rib to move the bar forwardly one tooth at a time.

5. A toy simulated power driven reciprocating saw workshop according to claim 4 wherein the power driven toothed rack means comprises a power driven hand gun for rotatably driving a pinion gear, a toothed rack, and means coupling the pinion gear to the toothed rack for reciprocally driving the rack.

6. A toy simulated power driven reciprocating saw workshop according to claim 5 wherein the coupling means comprises a circular gear in meshing engagement with the pinion gear, the circular gear having a laterally extending eccentric pin, and a horizontal slot in the toothed rack for receiving the pin.

7. A toy simulated power driven reciprocating saw workshop for simulating the sawing action of a power driven reciprocating saw cutting a groove through a board, comprising:

an elongated board having an elongated slot extending therethrough at each end thereof, the board having a mid-section defining a tunnel;

a pair of spaced-apart rows of substantially right-angled saw teeth along one side of the slot, the rows of saw teeth arranged in facing, staggered relation;

an elongated bar having its mid-section supported within the tunnel and its end section supported between the rows of saw teeth in parallel relation, the bar end sections each having a rib on its end surface and upper and lower lugs facing the rows of said saw teeth; and a power driven reciprocating toothed rack means mountable within the slot which is adapted when reciprocated and pressed forwardly along the slot to cause the upper and lower lugs to move forwardly from one tooth to the other simulating the movement of a real power driven reciprocating saw cutting through a board.

8. A toy simulated power driven reciprocating saw workshop according to claim 7 wherein the power driven toothed rack means comprises a power driven hand gun for rotatably driving a pinion gear, a toothed rack, and means coupling the pinion gear to the toothed rack for reciprocally driving the rack.

9. A toy simulated power driven reciprocating saw workshop according to claim 8 wherein the coupling means comprises a circular gear in meshing engagement with the pinion gear, the circular gear having a laterally extending eccentric pin, and a horizontal slot in the toothed rack for receiving the pin.

* * * * *

UNITED STATES PATENT AND TRADEMARK OFFICE

CERTIFICATE OF CORRECTION

PATENT NO. : 4,713,036

DATED : December 15, 1987

INVENTOR(S) : David E. Moomaw

It is certified that error appears in the above-identified patent and that said Letters Patent is hereby corrected as shown below:

Title of Invention should read

-- TOY SIMULATED POWER DRIVEN RECIPROCATING SAW WORKSHOP --.

Signed and Sealed this

Sixteenth Day of August, 1988

*Attest:*

DONALD J. QUIGG

*Attesting Officer*

*Commissioner of Patents and Trademarks*